US005962376A

United States Patent [19]

Yamazaki et al.

[11] Patent Number: 5,962,376

[45] Date of Patent: Oct. 5, 1999

[54] RESIN COMPOSITION FOR SLIDING MEMBER AND RESIN GEAR

[75] Inventors: Masayuki Yamazaki, Inabe-gun; Kazuo Hirose; Sadatoshi Inagaki, both of Yokkaichi, all of Japan

[73] Assignee: NTN Corporation, Japan

[21] Appl. No.: 09/025,767

[22] Filed: Feb. 18, 1998

[30] Foreign Application Priority Data

Feb. 25, 1997 [JP] Japan ..... 9-040211

[51] Int. Cl.[6] ..... C10M 161/00

[52] U.S. Cl. ..... 508/106; 508/100; 508/107; 508/108

[58] Field of Search ..... 508/100, 106, 508/107, 108

[56] References Cited

U.S. PATENT DOCUMENTS 4,847,135 7/1989 Braus et al. ..... 508/100
5,258,441 11/1993 Nagahiro et al. .
5,427,698 6/1995 Hirokawa et al. ..... 508/106
5,466,737 11/1995 Oki et al. .

FOREIGN PATENT DOCUMENTS 5306371 11/1993 Japan .
6192573 7/1994 Japan .
6279689 10/1994 Japan .
09087533 3/1997 Japan .

*Primary Examiner*—Jerry D. Johnson
*Attorney, Agent, or Firm*—Hedman, Gibson & Costigan, P.C.

[57] ABSTRACT

A resin composition, for sliding member, which has a high degree of mechanical strength and wear resistance regardless of whether grease is applied to gears or the like formed thereof, attacks mating member formed of unflexible materials as well as flexible materials, is moldable, and can be molded into a product; and a gear formed thereof. The resin composition for sliding member comprises a resin; a solid lubricant; a whisker having Mohs hardness of five or more and a whisker having Mohs hardness of less than five.

17 Claims, 1 Drawing Sheet

RESIN COMPOSITION FOR SLIDING MEMBER AND RESIN GEAR

BACKGROUND OF THE INVENTION

The present invention relates to a resin composition for sliding member and resin gear. More particularly, the present invention relates to a resin composition applicable for plain bearings, gears, and the like required to have a high degree of wear resistance.

In recent years, plain bearings and gears obtained by molding the resin composition are used in a large number as mechanical component parts of acoustic equipments, office appliances such as copying machines, vehicles, and other equipments. The plain bearings and gears formed of the resin composition cannot be used under a very high load and at high temperatures, unlike plain bearings and gears formed of metal. But, the plain bearings and gears formed of the resin composition are increasingly used because they are light, inexpensive, eliminates the need for using grease, and can be formed by one-piece molding.

The plain bearings and gears formed of the resin composition are required to have two characteristics that they are resistant to wear and do not attack a mating member at a high degree. That is, it is necessary that they and the mating member have a small amount of wear in their sliding contact. But the two characteristics are contradictory to each other. For example, the wear amount of gears formed of a polyphenylene sulfide resin composition is very great unless a fibrous filler is added to the resin composition. Thus, glass fiber is frequently added to the polyphenylene sulfide resin composition. But when the mating member are formed of a soft material, for example, aluminum or synthetic resin, a gear or the like formed of the resin composition attacks them at a high degree, i.e., it wears the mating member in a large amount because the glass fiber is harder than aluminum or synthetic resin. On the other hand, when a gear or the like formed of the resin composition contains a soft filler such as carbon fiber comparatively soft, it attacks the mating member in a small amount but the gear has a weak strength and are worn in a large amount.

The following resin compositions were proposed to overcome the problem, as disclosed in Laid-Open Japanese Patent Publications Nos. 5-306371 and 6-279689. The resin composition disclosed in the former comprises polyphenylene sulfide resin, polytetrafluroethylene resin, aromatic polyamide pulp, and zinc oxide whisker. The resin composition disclosed in the latter comprises synthetic resin, whisker, aromatic polyamide fiber, and solid lubricant.

In recent years, it is important to miniaturize office appliances and make the degree of noises which are generated during the operation thereof as low as possible. However, it is very difficult to form the plain bearings and gears of the conventional resin composition incapable of satisfying such demands.

The aromatic polyamide pulp and the aromatic polyamide fiber have a small apparent specific gravity, respectively and are voluminous fillers. Thus, it is necessary to granulate a resin composition and injection-mold pellet in a restricted condition, respectively. Thus, it is impossible to mold the resin composition containing the aromatic polyamide pulp or the aromatic polyamide fiber into a compact, light, and shape-complicated product.

Further, the aromatic polyamide pulp and the aromatic polyamide fiber pollute a die because they generate gas in the injection molding process. Therefore, it is necessary to clean the die repeatedly after it is used predetermined number of times, which makes it difficult to accomplish continuous molding of the resin composition containing the aromatic polyamide pulp or the aromatic polyamide fiber.

Furthermore, because the aromatic polyamide pulp and the aromatic polyamide fiber are hygroscopic, a product formed by molding the resin composition containing the aromatic polyamide pulp or the aromatic polyamide fiber may have foam formed thereon unless pellet is dried before the injection molding is performed. Further, the resin composition containing the above-described material is costly and causes the manufacturing cost to increase because of a large number of processes. Thus, plain bearings and gears formed of the resin composition containing the above-described material has a limitation in industrial application.

To prevent big noises from being generated by office appliances due to engagement of gears which are used at a fixing section or the like, of a copying machine, which are subjected to a high-load application and high temperatures, grease is applied thereto supposing that they are formed of sintered iron or the like. In this case, grease attaches to a mating gear formed of resin, thus catching resin powders and powders of fibrous reinforcing materials generated by the wear thereof. As a result, the powders act as an abrasive material on the interface between the both gears. That is, both gears are worn to a great extent. This trouble occurs outstandingly in the case where a gear is formed of a resin composition containing reinforcing glass fibers.

SUMMARY OF THE INVENTION

It is an object of the present invention to provide a resin composition for sliding member, which has a high degree of mechanical strength, has high wear resistance regardless of whether grease is applied to gears or not, does not attack the mating member formed of soft materials as well as hard materials such as iron, and can be easily molded into products which can be usefully used in industry; and a gear formed thereof.

The resin composition for sliding member of the present invention comprises a resin, a solid lubricant, a hard whisker having Mohs hardness of five or more, and a soft whisker having Mohs hardness of less than five.

The amount of the soft whisker is greater than that of the hard whisker.

The soft whisker comprises at least one whisker selected from the group consisting of wollastonite whisker, calcium sulfate whisker, calcium carbonate whisker, and potassium titanate whisker. The hard whisker comprises at least one whisker selected from the group consisting of aluminum borate whisker, magnesium borate whisker, titanium oxide whisker, silicon nitride whisker, silicon carbide whisker, alumina whisker, and mineral fiber.

The resin composing the resin composition comprises at least one resin selected from the group consisting of polyarylene sulfide resin, polyether ketone resin, and thermoplastic polyimide resin.

The solid lubricant composing the resin composition is polytetrafluoroethylene.

A gear is formed of a molded product of the resin composition.

The resin composition of the present invention has a high degree of flowability because it comprises the whiskers having different Mohs hardness. Gears, plain bearings or the like produced by molding the resin composition do not wear the mating member in a high extent when they slidably contact each other and are highly resistant to wear.

DESCRIPTION OF THE PREFERRED EMBODIMENTS

Figure 1:
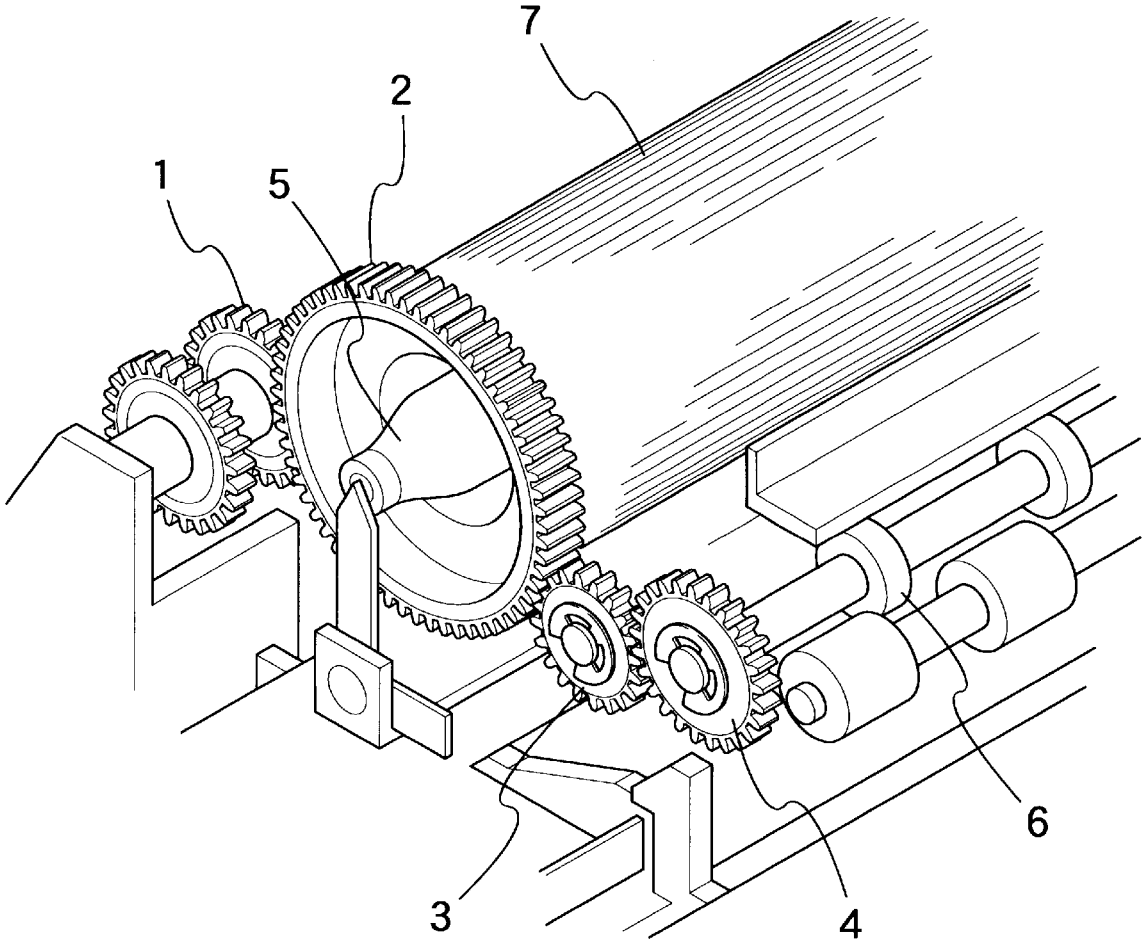
FIG. 1 is an exploded perspective view showing an example of a gear formed of the resin composition of the present invention and installed in the periphery of a fixing section of an image-forming apparatus.

The resin composition of the present invention can be selected according to heat-resistant temperature, atmospheres, and other conditions required for sliding members formed thereof.

The following resins can be used as the material of the resin composition of the present invention: Polyacetal resin, polyamide resin, polyethylene resin, polyimide resin, polyamideimide resin, thermoplastic polyimide resin, polyether ether ketone, polyether ketone resin, polyether nitrile resin, aromatic polyester resin, phenol resin, epoxy resin, and polyphenylene sulfide resin. These resins can be used singly or as polymer alloys or polymer blends composed of two or more of these resins.

Of the above-described resins, polyarylene sulfide resin such as the polyphenylene sulfide resin, the polyether ketone resin such as the polyether ether ketone, and the thermoplastic polyimide resin are more favorable than the other resins as the material of sliding member because each of them has a high degree of heat resistance, mechanical strength, and moldability. The polyphenylene sulfide resin is more favorable than the polyether ketone resin and the thermoplastic polyimide resin because it is more moldable, less expensive, and more usefully applied in industry than the other two resins.

The polyphenylene sulfide resin as one of the polyarylene sulfide resin has a structure in which aromatic groups are connected with one another in the form of thioether connection. The repeating unit is shown below by an formula (I):

$$—R—S— \quad (I)$$

where R indicates the following group:

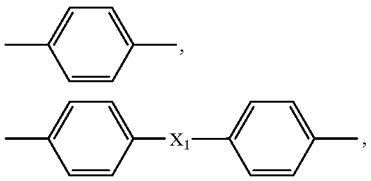

-continued

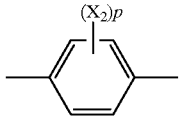

where $X_1$ indicates $—SO_2—$, —O—, $—CH_2—$, $—C(CH_3)_2—$; $X_2$ represents halogen or $—CH_3$; and p indicates integers of 1–4.

Of the above polyphenylene sulfide resin, the formula (II) shown below is typical and sold on the market in a trademark "Ryton" produced by Phillips Petroleum Corporation. The manufacturing process is disclosed in U.S. Pat. No. 3,354,129 (related Japanese patent: Examined Japanese Patent Publication No. 45-3368).

(II)

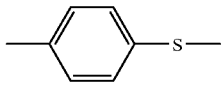

According to the disclosure, "Ryton" is manufactured by reacting p-dichlorobenzene and sodium disulfide with each other in a solvent of N-methyl-2-pyrrolidone at 160–250° C. under a pressurized condition. In this case, it is possible to manufacture polyphenylene sulfide resins having various degrees of polymerization, namely, those having no crosslinked structure and those having partial crosslinked structure by post-heating the product of the reaction. Thus, it is possible to selectively use a melted blend having a melting viscosity characteristic appropriate for a purpose. In addition, it is possible to use straight-chain polyphenylene sulfide resin having no crosslinked structure, depending on a purpose.

The favorable melting viscosity of the polyphenylene sulfide resin is 10–10,000 Pa.s; more favorably, 30–3,000 Pa.s; and most favorably, 50–800 Pa.s. Also, the polyphenylene sulfide resin having SH end group can be used.

The following polyphenylene sulfide resins are commercially available: T4AG (Tohpren Co., Ltd., trade name), B160 (Toso Co., Ltd., trade name), and KPS W214 (Kureha Chemical Industry Co., Ltd., trade name).

The polyether ketone resin has a repeating unit indicated by an formula (III) shown below, or has a repeating unit (III) and repeating unit (IV) which is added in such a manner that the characteristic of the polyether ketone resin is not lost.

(III)

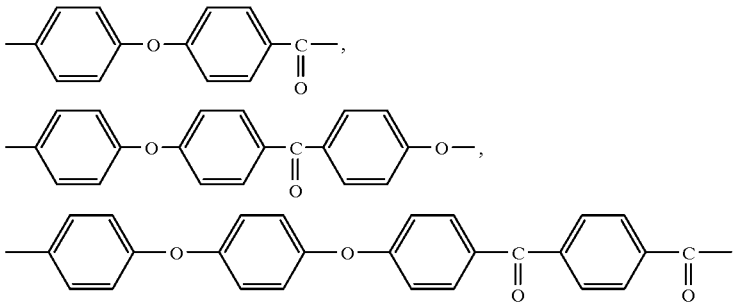

-continued (IV)

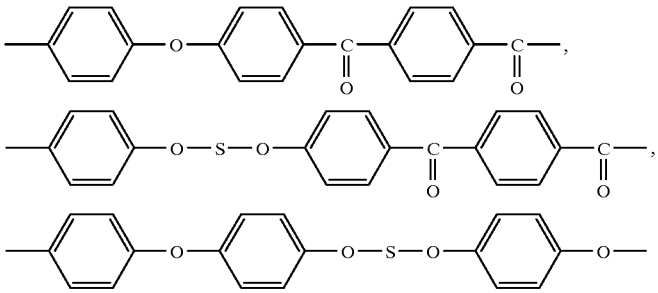

The polyether ketone resin is commercially available as follows: PEEK150P (VICTREX MFG Ltd., trade name) shown by an formula (V) shown below; PEK220G (ICI Corp., trade name) shown by an formula (VI) shown below; and Ultrapek A2000 (BASF AKTIENGESELLSHAFT, trade name) indicated by an formula (VII) shown below. The manufacturing process of these resins are disclosed in Laid-Open Japanese Patent Publication No. 54-90265.

(V)

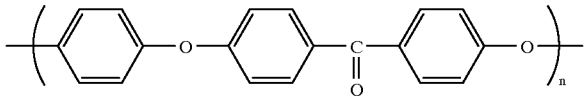

(VI)

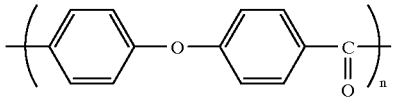

(VII)

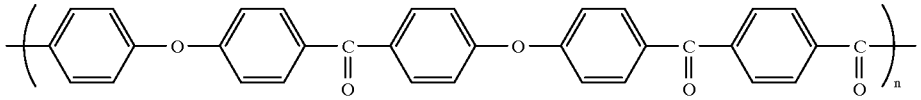

The thermoplastic polyimide resin has a repeating unit of imide group and a plurality of ether linkages in its molecular structure, in which the imide group contribute to be superior in thermal characteristic and mechanical strength of the resin and the ether linkages to be an appropriate melting characteristic when heat energy is applied thereto.

The thermoplastic polyimide resin having two ether linkages in the repeating unit is preferable because it has a high degree of mechanical characteristics, rigidity, heat resistance, and injection moldability. For example, thermoplastic polyimide resin prepared by the reaction of aromatic ether diamines or aromatic ether diisocyanates with an acid anhydride, for example, pyromellitic anhydride, benzophenontetracarboxylic anhydride, and biphenyltetracarboxylic anhydride, or its derivatives.

An example of polymers having the imide group and the aromatic group is shown by an formula (VIII) shown below.

(VIII)

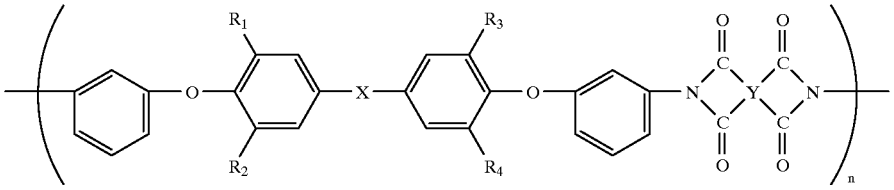

In the formula (VIII), X denotes a group selected from the group consisting of a direct bond, a hydrocarbon group having 1–10 carbon atoms, a hexafluorinatedisopropylidene group, a carbonyl group, a thio group, and sulfone group; $R_1$–$R_4$ are same or different and denotes hydrogen, a lower alkyl group (preferably, number of carbon atoms 1–5) a lower alkoxy group (preferably, number of carbon atoms 1–5), chlorine or bromine. Y denotes a quadrivalent group selected from the group consisting of an aliphatic group having two or more carbon atoms, an alicyclic group, a mono-cyclic aromatic group, a condensed polycyclic aromatic group, and an uncondensed polyaromatic group having aromatic groups connected with each directly or through crosslinked group.

The thermoplastic polyimide resin shown by the formula (VIII) is obtained by cyclodehydration reaction of polyamide acid which is prepared by the reaction of aromatic etherdiamine shown by the formula (IX) and one or more aromatic tetracarboxylic dianhydrides.

(IX)

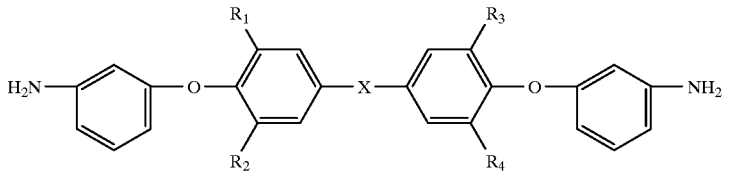

In the formula (IX), X denotes a group selected from the group consisting of a direct bond, a hydrocarbon group having 1–10 carbon atoms, a hexafluorinatedisopropylidene group, a carbonyl group, a thio group, and sulfone group; $R_1$–$R_4$ are same or different and denotes hydrogen, a lower alkyl group (preferably, number of carbon atoms 1–5), a lower alkoxy group (preferably, number of carbon atoms 1–5), chlorine or bromine.

The thermoplastic polyimide resin as described above is commercially available in a commercial name AURUM (manufactured by Mitsui Chemical Co., Ltd.) in which $R_1$–$R_4$ shown by the formula (VIII) are all hydrogen.

As the solid lubricant, fluororesin such as polytetrafluoroethylene (hereinafter referred to as PTFE), graphite, and molybdenum disulfide can be preferably used. These substances can be used singly or in the form of a mixture thereof.

The PTFE is more favorable than the other solid lubricants because the former is more lubricative than the latter. The PTFE can be used in the form of "molding powder" obtained by suspension polymerization method and "fine powder" obtained by emulsion polymerization method. The "molding powder" and the "fine powder" are hereinafter referred to as "virgin PTFE". In addition, it is possible to use powders obtained by pulverizing the virgin PTFE after pressurizing and heating, or by irradiating the gamma ray to the virgin PTFE which is pulverized after pressurizing and heating. The powders which are thus obtained are hereinafter referred to as "recycled PTFE".

Because the virgin PTFE contained in the resin composition becomes fibrous when the resin composition is granulated, it is not preferable for the resin composition to contain a large amount of the virgin PTFE therein. But it has a reinforcing effect when a small amount thereof is added to the material of the resin composition. Thus, it is preferable to use the virgin PTFE in combination with the recycled PTFE and other solid lubricants.

Favorably, the resin composition comprises 5–100 parts by weight and more favorably, 5–80 parts by weight of the solid lubricant with respect to 100 parts by weight of resin. The addition of the solid lubricant to the resin in the above range improves the lubricity of the resin composition, with the other characteristics thereof maintained.

The whisker used in the present invention is a short fiber material having an average aspect ratio of 10 or more. The fibrous length thereof is 100 $\mu$m or less. A mixture of two or more kinds of whiskers is added to the material of the resin composition. That is, the resin composition contains at least two kinds of whiskers mixed with each other: One whisker is the soft whisker which has Mohs hardness of less than five and the other whisker is the hard whisker which has Mohs hardness of five or more.

The soft whisker reinforces a gear comprising the whisker in a low degree but prevents the gear and mating member from abnormally worn even though grease is applied thereto. On the other hand, the hard whisker reinforces the gear in a high degree but causes the gear and the mating member to be abnormally worn easily.

Because the resin composition of the present invention contains the mixture of the soft whisker hard whisker, the resin composition allows plain bearing and the gear formed thereof to have reinforcing effect and wear resistance well balanced therewith.

There are two Mohs hardness standards, a new and an old one. The Mohs hardness shown in the present invention are all given under the old standard. Any fibrous reinforcing materials having a Mohs hardness higher than five is judged to be a hard material, and one having a Mohs hardness of less than five is regarded as a soft material.

Wollastonite whisker (Mohs hardness: 4.5), calcium sulfate whisker (Mohs hardness: 3), calcium carbonate whisker (Mohs hardness: 3.5–4), and potassium titanate whisker (Mohs hardness: 3.5) can be favorably used as the soft whisker.

The wollastonite whisker and/or the calcium carbonate whisker are more favorable than the other whiskers because the former is less expensive and more effective than the latter in reinforcing the gear and the mating member formed of the resin composition.

Aluminum borate whisker (Mohs hardness: 7–7.5), magnesium borate whisker (Mohs hardness: 5.5), titanium oxide whisker (Mohs hardness: 7–7.5), silicon nitride whisker (Mohs hardness: 9), silicon carbide whisker (Mohs hardness: 9), alumina whisker (Mohs hardness: 9), and mineral fiber (Mohs hardness: 6) obtained by melting and purifying igneous rock can be favorably used as the hard whisker.

The aluminum borate whisker and the mineral fiber are more favorable than the other whiskers because the former has longer fibers and are more effective than the latter in reinforcing the gear and the mating member formed of the resin composition.

When the resin composition of the present invention contains the soft whisker larger than the hard whisker, the resin composition reinforces the gear and the mating member favorably and allows them to be highly resistant to an abnormal wear even though grease is applied thereto.

It is favorable that the whisker consists of 100 parts by weight of the hard whisker and 100–1000 parts by weight of the soft whisker. It is more favorable that the whisker consists of 100 parts by weight of the hard whisker and 150–500 parts by weight of the soft whisker.

Favorably, the resin composition comprises 100 parts by weight of the resin and 5–250 parts by weight of the whisker; more favorably, 10–150 parts by weight of the whisker with respect to 100 parts by weight of the resin; and most favorably, 20–100 parts by weight of the whisker with respect to 100 parts by weight of the resin. When the whisker is mixed with the resin in the range of 5–250 parts by weights, the resin composition is allowed to have improved reinforcing effect and products formed by molding the resin composition is allowed to have improved wear resistance. The resin composition of the present invention is more moldable than a resin composition containing the whisker and an aromatic polyamide fibrous material.

The resin composition can be preferably used as a material of plain bearings and gears. More specifically, it can be preferably used as a material to compose an idler gear whose peripheral surface rotate with sliding contact. Mechanical member such as plain bearings and gears can be used for image-forming apparatuses such as printers and printing machines, for example, wet or dry electrostatic copying machines (PPC) of toner image transfer type, laser beam printers (LBP), liquid crystal shutter printers (LCD), printers for facsimiles, light emitting diodes (LED), printers (CRT) adopting silver salt photographic method.

The mechanical member such as plain bearings and gears for example, an idler gear having a plain bearing can be used at a photosensitive section, a developing section, and a fixing section of an image-forming apparatus. But in consideration of the superior heat resistant property of the polyarylene sulfide resin, the polyether ketone resin, the thermoplastic polyimide resin which are contained in the resin composition, it is preferable to use them in the periphery of the fixing section because the fixing section is subjected to a higher temperature than the photosensitive section and the developing section.

Gears formed of the resin composition which is used in the fixing section of the image-forming apparatus are described below.

As shown in FIG. 1, in the periphery of the fixing section of the image-forming apparatus, there are provided a driving gear 1, a fixing roller gear 2, an idler gear 3, a paper discharge roller gear 4, a heater 5, a paper discharge roller 6, and a fixing roller 7. When the gear formed of the resin composition of the present invention is used in the periphery of the fixing section of the image-forming apparatus in which it is subjected to a higher temperature than the photosensitive section and the developing section, it maintains its superior mechanical strength, wear resistance, and wears the mating member to a low extent.

Materials used in examples and comparative examples are listed below. Abbreviated words and chemical symbols in [ ] are used in table 1. The materials were mixed with each other at parts by weight as shown in table 1.

(1) Resin 1: polyphenylene sulfide resin [PPS]: #160 (manufactured by Toso Co., Ltd., trade name)

(2) Resin 2: polyimide resin [PI]: AURUM 450 (manufactured by Mitsui Chemical Co. Ltd, trade name)

(3) Resin 3: polyether ether ketone resin [PEEK]: PEEK150P (manufactured by VICTREX Corp., tradename)

(4) Whisker 1: wollastonite whisker [$CaSiO_3$]; Mohs hardness 4.5: Kemorit ASB8 (manufactured by Maruwa Biochemical Co. Ltd, trade name)

(5) Whisker 2: calcium carbonate whisker [$CaCO_3$]; Mohs hardness; 4: Whiskal AS3 (manufactured by Maruo Calcium Co., Ltd., trade name)

(6) Whisker 3: calcium sulfate whisker [$CaSO_4$]; Mohs hardness: 3: Franklin Fiber A30 (manufactured by Dainichiseika Co., Ltd., trade name)

(7) Whisker 4: aluminum borate whisker [$9Al_2O_3.2B_2O_3$]; Mohs hardness 7: Albolex Y (manufactured by Shikoku Kaseikogyo Co., Ltd., trade name)

(8) Whisker 5: mineral fiber [$SiO.Al_2O_3$]; Mohs hardness 6: Rapinas Rock Fill RF 5104 (manufactured by Rapinas Fibers Co., Ltd., trade name)

(9) Solid lubricant 1: recycled PTFE [PTFE-1]; KT400H (manufactured by Kitamura Co., Ltd., trade name)

(10) Solid lubricant 2: Virgin PTFE [PTFE-2]: TEFLON-7J (manufactured by Du pont corp, trade name)

(11) Aromatic polyamide fiber: [ARPA]: Cornex Cut Fiber 1 mm (manufactured by Teijin Co., Ltd., trade name)

(12) Carbon fiber: [CF]: Kureka Chop M104T (manufactured by Kureha Chemical Co., Ltd., trade name)

EXAMPLES 1–6 AND COMPARATIVE EXAMPLES 1–4

The materials were mixed with one another at the parts by weight shown in table 1. The mixture was sufficiently kneaded by a Henshel mixer and supplied to a biaxial melting extruder to form pellets. The pellets were supplied to an injection molder to mold it into specimens, using a die. Tests were conducted to evaluate the specimens.

(a) Frictional Wear Test

Using a frictional wear tester, the friction coefficients and the abrasion coefficients of specimens were measured. The outer diameter, the inner diameter, and the height of each specimen were ϕ21 mm, ϕ17 mm, and 10 mm, respectively. As the test condition, the sliding speed was 6 m/min; the pressure applied to each specimen was 5 $kgf/cm^2$; the atmospheric temperature was 120° C., the test period of time was 100 hours. Each specimen was subjected to sliding contact with rolled steel (SS41) as the mating member. Lubricant was not used in the test.

(b) Durability Test of Gear

Using a gear durability tester of power absorption type manufactured by the NTN corporation, idler gears (module=1, number of teeth=35, and tooth width=8) whose inner peripheral surfaces rotated in sliding contact with the rolled steel were formed of the resin composition of the embodiments and the comparative examples. Driving gears (module=1, number of teeth=5, and tooth width=8) comprises glass-reinforced PPS. Load-applied gears (module=1, number of teeth=35, and tooth width=8) comprised polyacetal resin.

To conform to the specification at the fixing section of a copying apparatus, the tester was driven 500 hours continuously in a condition that the number of rotations of the driving shaft was 125 rpm, the applied torque was 2.5 kgf-cm, and the atmospheric temperature was 150° C. At the start time of the test, grease was applied to the surface of the driving gears. The wear amount (mg) of each idler gear, that of each driving gear, and that of each load-applied gear were measured after the test finished.

(c) Moldability

Respective resin compositions shown in table 1 were observed when they were injection-molded to form the specimens. Resin compositions which could be molded in 1,1000 shots continuously were evaluated as ○ and those which could not be molded in 1,1000 shots continuously were evaluated as X.

TABLE 1

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Formulation (Part by wt.) | | | | | | | | | | |
| PPS | 100 | 100 | 100 | — | — | 100 | 100 | 100 | 100 | 100 |
| PI | — | — | — | 100 | — | — | — | — | — | — |
| PEEK | — | — | — | — | 100 | — | — | — | — | — |
| $CaSiO_3$ | 30 | — | 44 | 76 | 40 | 30 | — | 45 | — | — |
| $CaCO_3$ | — | 22 | — | — | 63 | — | — | — | — | — |
| $CaSO_4$ | — | — | — | — | — | — | 30 | — | — | — |
| $9Al_2O_3.2B_2O_3$ | 15 | 5 | 33 | 10 | 34 | 15 | 20 | — | 40 | — |
| SiO, $Al_2O_3$ | — | 7 | — | — | — | — | — | — | — | — |
| PTFE-1 | 40 | 35 | 44 | 30 | 40 | 40 | 23 | 35 | 35 | 35 |
| PTFE-2 | — | — | — | — | — | 5 | — | — | — | — |
| ARPA | — | — | — | — | — | — | 25 | — | — | — |
| CF | — | — | — | — | — | — | — | — | — | 20 |
| Test Result | | | | | | | | | | |
| (a) Frictional wear test | | | | | | | | | | |
| Friction coefficient | 0.25 | 0.30 | 0.32 | 0.22 | 0.33 | 0.25 | 0.29 | 0.31 | 0.40 | 0.38 |
| Abrasion coefficient*1 | 80 | 70 | 72 | 65 | 85 | 80 | 95 | 110 | 95 | 85 |
| (b) Durability test of Gear | | | | | | | | | | |
| Idler Gear | 8.5 | 9.4 | 13.0 | 17.2 | 9.8 | 8.5 | 11.0 | 47*2 | 21.4 | 153 |
| Driving Gear (PPS) | 0.7 | 0.9 | 0.9 | 0.4 | 0.9 | 0.7 | 0.7 | 0.5 | 0.6 | 1.1 |
| Load-applied Gear (POM) | 13.5 | 13.0 | 19.0 | 11.5 | 21.2 | 13.5 | 14.3 | 31.5 | 127 | 205 |
| (c) Moldability | ○ | ○ | ○ | ○ | ○ | ○ | X*3 | ○ | ○ | ○ |

Note
*1: $\times 10^{-10}$ $cm^3/kg \cdot m$
*2: Idler Gear was broken at 380 hours after test stated.
*3: Die was polluted by generated gas about 800 shots after test stated.

As table 1 indicates, the specimen of the examples 1–6 containing an appropriate amount of the hard whisker and soft whisker had a small amount of wear and wore the mating gear in a low degree. In addition, the specimens were moldable.

The specimen of the comparative example 1 containing an appropriate amount of the hard and soft whisker, and the aromatic polyamide fiber had a low degree of moldability and is expensive than the specimen of the embodiment 1 by about 30% in the manufacturing cost.

The specimen of the comparative example 2 containing the soft whisker alone was not effective for reinforcing the gear. Thus, the gear was partly broken.

The specimen of the comparative example 3 containing the hard whisker alone wore the mating gear comprising the polyacetal to a high extent.

The specimen of the comparative example 4 containing the carbon fiber instead of the whisker was worn and wore the mating gear in a high degree.

Because the resin composition of the present invention comprises the solid lubricant, the hard whisker having Mohs hardness of five or more, and the soft whisker having Mohs hardness of less than five, it has a high degree of mechanical strength and wear resistance and yet does not wear the mating gear in a high extent when they operate slidably contact each other.

The above-described characteristics of the resin composition can be improved to a higher extent when the resin composition contains the soft whisker larger than the hard whisker, when the wollastonite whisker is used as the soft whisker, when the aluminum borate whisker is used as the hard whisker, and the polyphenylene sulfide resin is used as the resin of the resin composition or when these materials are contained in the resin composition in combination. Consequently, plain bearings and gears produced by molding the resin composition of the present invention have a high degree of mechanical strength and wear resistance and yet do not wear mating components parts in a high extent when they slidably contact each other.

What is claimed is:

1. A resin composition for a molded sliding member comprising:

a resin;

a solid lubricant; and a whisker, wherein said whisker comprising a hard whisker having a Mohs hardness of five or more and a soft whisker having a Mohs hardness of less than five; and the amount of the soft whisker is greater than that of the hard whisker.

2. A resin composition according to claim 1, wherein said whisker consists of 100 parts by weight of said hard whisker and greater than 100–1000 parts by weight of said soft whisker.

3. A resin composition according to claim 2, wherein said whisker consists of 100 parts by weight of said hard whisker and 150–500 parts by weight of said soft whisker.

4. A resin composition according to claim 1, wherein said soft whisker comprises at least one whisker selected from the group consisting of wollastonite whisker, calcium sulfate whisker, calcium carbonate whisker, and potassium titanate whisker.

5. A resin composition according to claim 4, wherein said soft whisker comprises at least one whisker selected from the group consisting of wollastonite whisker and calcium carbonate whisker.

6. A resin composition according to claim 1, wherein said hard whisker comprises at least one whisker selected from the group consisting of aluminum borate whisker, magnesium borate whisker, titanium oxide whisker, silicon nitride whisker, silicon carbide whisker, alumina whisker, and mineral fiber.

7. A resin composition according to claim 6, wherein said hard whisker comprises at least one whisker selected from the group consisting of aluminum borate whisker and mineral fiber.

8. A resin composition according to claim 1, wherein said resin comprises at least one resin selected from the group consisting of polyarylene sulfide resin, polyether ketone resin, and thermoplastic polyimide resin.

9. A resin composition according to claim 8, wherein said polyarylene sulfide resin is polyphenylene sulfide resin.

10. A resin composition according to claim 8, wherein said polyether ketone resin has sequential units having the chemical structure consisting of a phenyl radical, an ether radical, a phenyl radical, a ketone radical, a phenyl radical and an ether radical.

11. A resin composition according to claim 8, wherein said thermoplastic polyimide resin is aromatic polyether imide resin.

12. A resin composition according to claim 1, wherein said solid lubricant is polytetrafluoroethylene.

13. A resin composition according to claim 1, wherein said composition comprises 100 parts by weight of said resin, 5–100 parts by weight of said solid lubricant, 5–250 parts by weight of said whisker.

14. A gear formed by molding a resin composition comprising a resin; a solid lubricant; and a whisker which comprises a hard whisker having a Mohs hardness of five or more and a soft whisker having a Mohs hardness of less than five; and the amount of the soft whisker is greater than that of the hard whisker.

15. A gear according to claim 14, wherein said resin comprises at least one resin selected from the group consisting of polyarylene sulfide resin, polyether ketone resin, and thermoplastic polyimide resin.

16. A gear according to claim 14, wherein said solid lubricant is polytetrafluoroethylene.

17. A gear according to claim 14, wherein said soft whisker comprises at least one whisker selected from the group consisting of wollastonite whisker and calcium carbonate whisker; and said hard whisker comprises at least one whisker selected from the group consisting of aluminum borate whisker and mineral fiber.

* * * * *